US005611717A

United States Patent [19]

Joly

[11] Patent Number: 5,611,717

[45] Date of Patent: Mar. 18, 1997

[54] MINIATURE ANTI-FRETTING RECEPTACLE TERMINAL

[75] Inventor: Jean C. Joly, Osny, France

[73] Assignee: The Whitaker Corporation, Wilmington, Del.

[21] Appl. No.: 426,544

[22] Filed: Apr. 21, 1995

[30] Foreign Application Priority Data

Apr. 22, 1994 [FR] France ..... 94 04870

[51] Int. Cl.[6] ..... H01R 11/22

[52] U.S. Cl. ..... 439/857; 439/252

[58] Field of Search ..... 439/857, 851, 439/843, 252

[56] References Cited

U.S. PATENT DOCUMENTS

| | | | |
|---|---|---|---|
| 5,334,058 | 8/1994 | Hotea | 439/851 |
| 5,415,571 | 5/1995 | Lutsch | 439/843 |

FOREIGN PATENT DOCUMENTS

| | | | |
|---|---|---|---|
| 0411888A2 | 6/1991 | European Pat. Off. . | |
| 0492479A2 | 1/1992 | European Pat. Off. . | |
| 000601564 | 6/1994 | European Pat. Off. | 439/843 |
| 002699010 | 6/1994 | France | 439/843 |
| 4319756A1 | 12/1994 | Germany . | |

*Primary Examiner*—Neil Abrams
*Assistant Examiner*—Eugene G. Byrd
*Attorney, Agent, or Firm*—Driscoll A. Nina

[57] ABSTRACT

A terminal comprises an inner contact and an outer body. The inner contact is U-shaped and has a spring section positioned between a connection section and a contact section for resilient longitudinal movement of the contact section with respect to the connection section for preventing fretting corrosion. The spring section is comprised within side walls and a bottom wall whereby this U-shape is easy to stamp and form thereby increasing the ease of manufacture, which is particularly important from miniature terminals.

9 Claims, 3 Drawing Sheets

MINIATURE ANTI-FRETTING RECEPTACLE TERMINAL

BACKGROUND OF THE INVENTION

1. Field of the Invention

This invention relates to an electrical terminal having a longitudinal spring for preventing contact fretting corrosion.

2. Description of the Prior Art

In some applications, for example in the automobile industry, electrical terminals are subject to vibrations that cause small relative micro-movements between mating contacts, which in turn causes fretting corrosion therebetween thereby increasing the contact resistance. In order to overcome fretting corrosion, receptacle terminals have been provided with longitudinal springs, as shown in European patent application 492479, whereby the spring force is less than the frictional force between mating tab and receptacle connector so as to prevent relative movements therebetween.

One of the problems with this design, however, is that it is difficult to manufacture due to the completely closed outer box shape, in particular for miniature contacts. A further problem with the receptacle of EP 492479, is that the longitudinal spring action functions essentially by bending, in the direction perpendicular to the plane of the sheet metal, of a side wall of the box extending between ends of a transverse slot. This means that there is a certain rotational movement of the end portion of the box from which the contacts extend, thereby causing small micro-rotations of the contact arms. For reduced spring forces in the longitudinal direction, which is necessary for example when the contact forces are reduced for some reason, the rotational movements of the contacts will be increased.

It would therefore be desirable to provide a receptacle terminal with improved anti-fretting characteristics.

SUMMARY OF THE INVENTION

It is an object of this invention to provide a terminal for reducing fretting corrosion, that is simple to manufacture, particularly for miniature contacts.

It is another object of this invention to provide a cost-effective terminal with longitudinal spring means to avoid fretting corrosion, whereby micro-rotational movement of the contacts is reduced.

The objects of this invention have been achieved by providing a terminal for receiving a complementary terminal inserted in that longitudinal direction, the terminal comprising an inner contact body having a contact section, a longitudinally resilient spring section, and a conductor connection section, where the spring section is positioned intermediate the connection and contact section, and wherein the inner contact body has a U-shape formed by a bottom wall and side walls whereby the longitudinally resilient spring section is comprised in the bottom and side walls. In an advantageous embodiment, the terminal has a box-shaped outer body positioned over the inner contact body and locked there.

DETAILED DESCRIPTION OF THE PREFERRED EMBODIMENT

Figure 5:
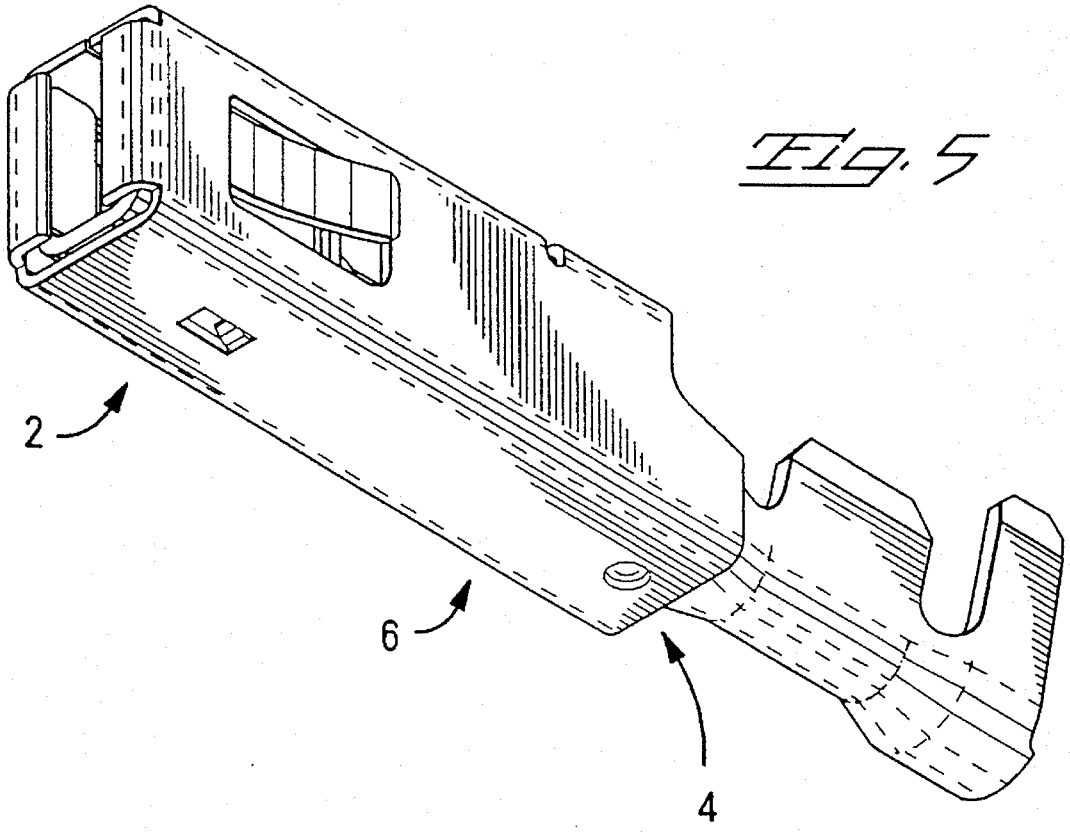
FIGS. 5 and 6 are isometric views of the assembled inner and outer bodies.
Figure 6:
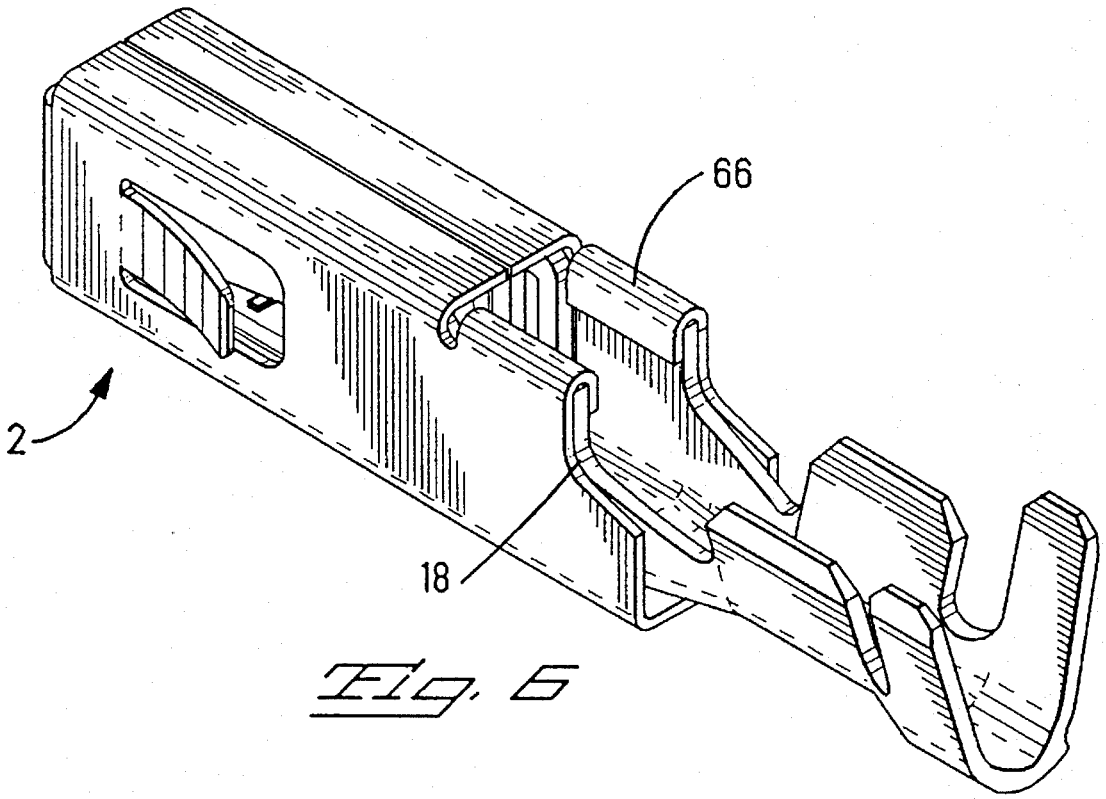

Referring first to FIGS. 5 and 6, a receptacle terminal 2 comprises an inner contact body 4 and an outer box-shaped body 6.

Figure 1:
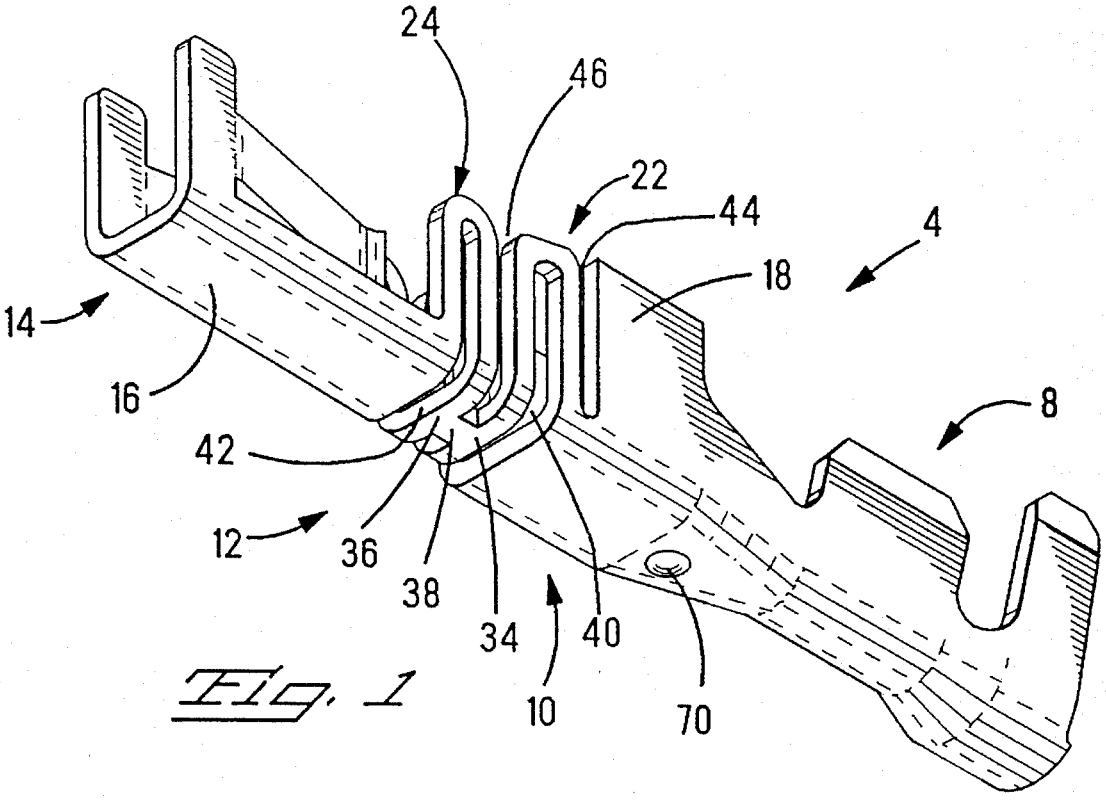
FIGS. 1 and 2 are isometric views of an inner contact body.
Figure 2:
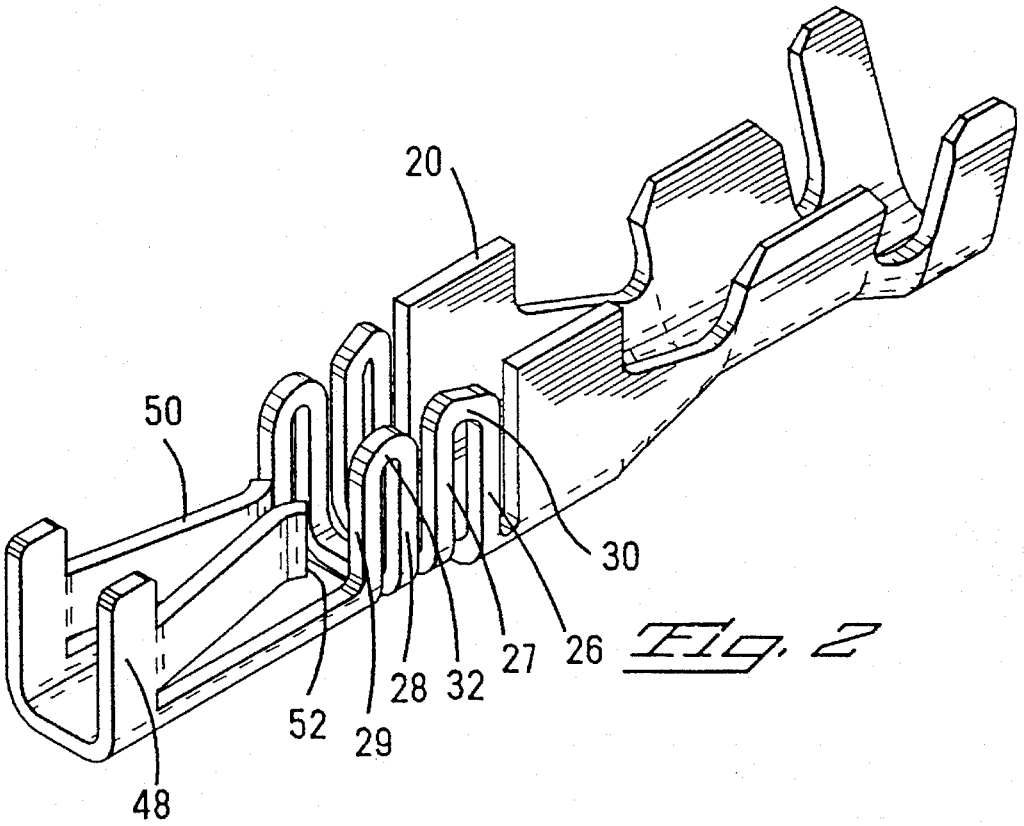
Figure 3:
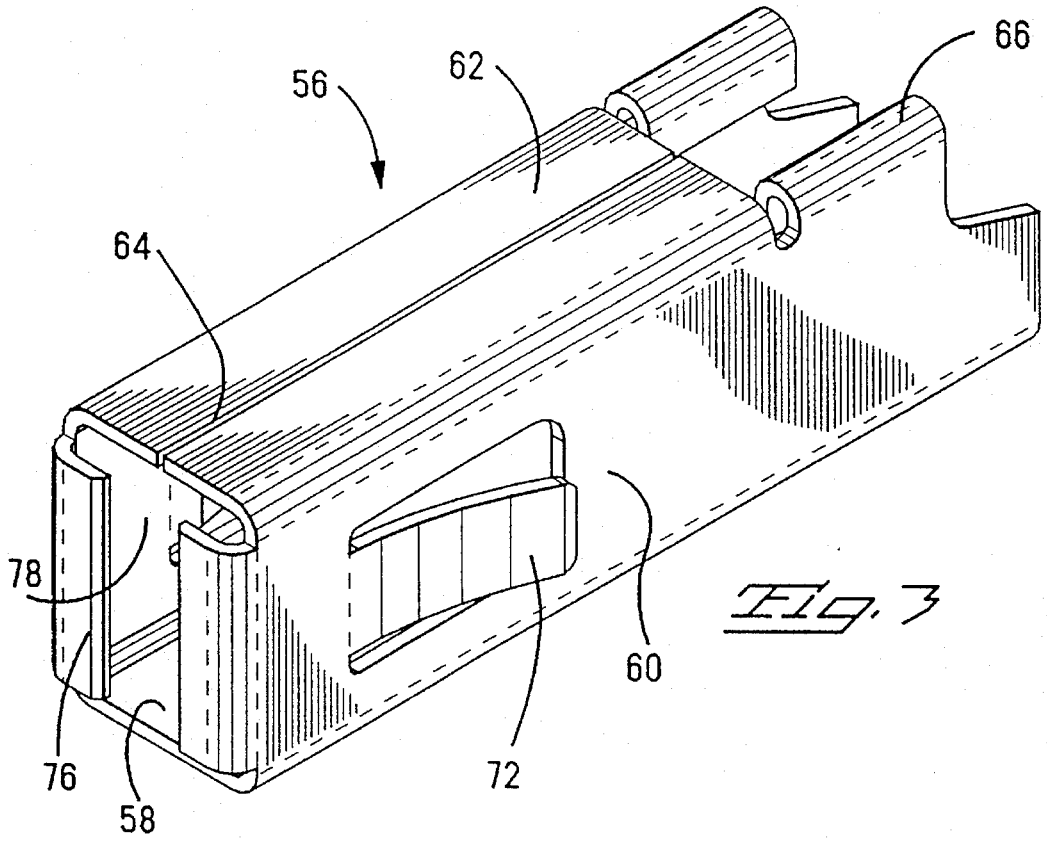
FIGS. 3 and 4 are isometric views of an outer body.

Referring now to FIGS. 1 and 2, the inner contact body 4 comprises a connection section 8 extending longitudinally into a U-shaped base section 10, spring section 12 and contact section 14. The connection section is for electrical connection to a conducting wire (not shown) by crimping, but could of course be any other suitable connection means. The base, spring and contact sections 10, 12, 14 are stamped and formed into a general U-shape comprising a bottom wall 16 and a pair of opposed side walls 18 extending substantially perpendicular from lateral edges of the bottom wall. The base section 10 comprises upper edges 20 for clinching of the outer body 6 thereto as seen in FIGS. 5 and 6.

The spring section 12 comprises two pairs of U-shaped resilient sections 22, 24 on each side wall and extending into the bottom wall. The sections 22, 24 each comprise a pair of resilient beams 26, 27 and 28, 29 respectively, each pair connected at an upper end by U-shaped bridging portions 30, 32. Adjacent spring beams 27, 28 of the sections 22, 24 respectively, are bent into base portions 34, 36 respectively which are joined together by a joining portion 38 comprised in the bottom wall 16. The spring beams 26, 27 and 28, 29 are separated by spring slots 40, 42 respectively, that extend continuously from the bridging portion 30 in one side wall to the bridging portion on the other side wall. Further spring slots 44, 46 are provided between the spring arm 26 and the base section 10 and between the spring arms 27 and 28 such that a long spring path is provided between the base section 10 and the contact section 14. A very compact yet supple spring in the longitudinal direction can thus be provided between the base and contact sections.

The contact section 14 comprises forward portions 48 of the side walls 18 from which extend rearwardly, opposed cantilever beam contact arms 50 that have free ends 52 proximate the spring section 12. As the cantilever beam contact arms 50 converge together, they provide a funnelled lead-in for guiding a complementary male tab terminal therebetween.

The frictional force created by the pressure of the contacts 50 against the complementary male tab, must be greater that the longitudinal spring force of a spring section 12 to ensure that during relative movements between the base section 10 and the complementary male tab, the contact section 14 remains stationary with respect to the complementary contact. The latter ensures that at the contact point there are no micro-movements thereby avoiding fretting corrosion. Due to the long spring path provided by the resilient beams 26–29 and the spring slots therebetween, the spring is very supple and can thus be easily made weaker than the frictional force. The longitudinal resilience is primarily a result of resilient bending of the beams 26, 27, 28, 29 within the plane of side walls 18, whereby the profiles of the beams and bridging portions can be designed such that no rotation of the contact section 14 occurs when it is extended or compressed in the longitudinal direction of the terminal. Micro-rotations of the cantilever beam contacts 50 can thus be reduced, thereby also reducing the effect on fretting corrosion.

A further advantage of providing the spring section in the side walls 18 and bottom walls 16, is the ease of manufacture, in particular for miniature terminals. The spring section can be simply edge stamped and then the side walls folded upwards from the base in a simple operation. It is far easier to form a U-shape than a closed box-shape as shown in European patent application 492479.

Figure 4:
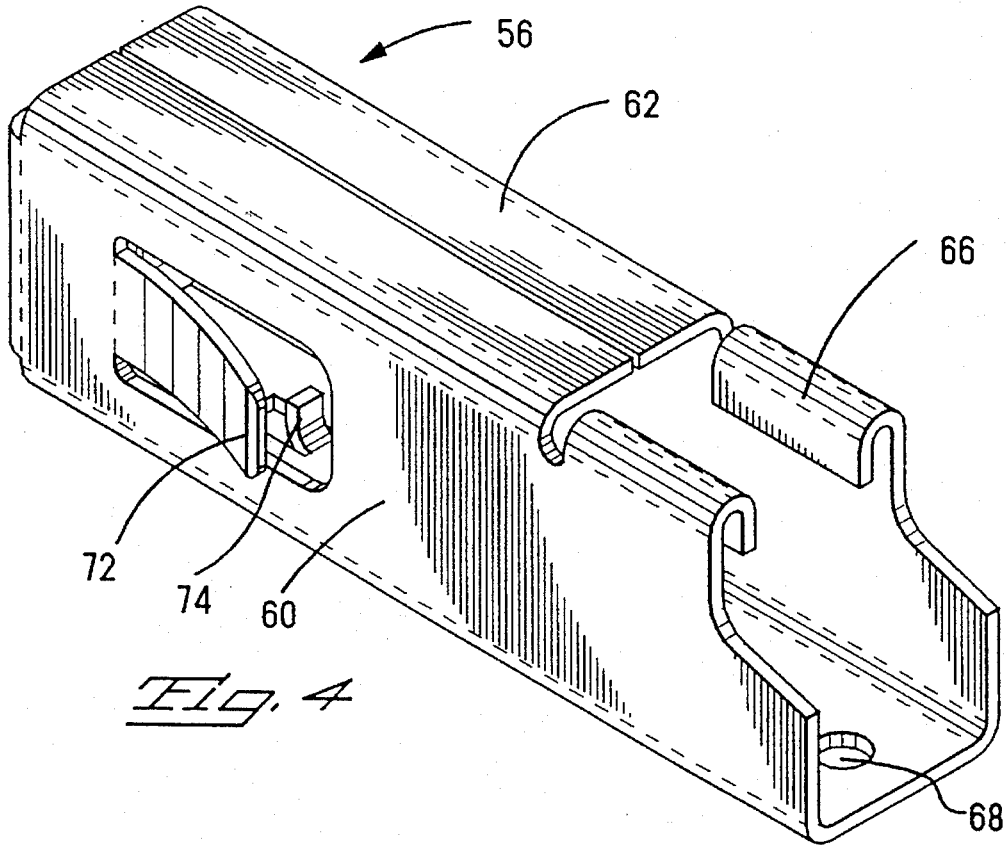

Referring now to FIGS. 4–6, the outer stamped and formed body 6 comprises a box-shaped body section 56 having a base wall 58, side walls 60 and top walls 62 joined together at a seam 64. Extending rearwardly from a rear end of the box-shaped body section, are U-shaped retention tabs 66 that are folded over the upper edges 20 of the inner contact base section 10 to secure the outer body thereto. Proximate a rear end of the bottom wall 58 is a retention hole 68 engageable with a protrusion 70 of the inner contact to further secure and position the outer body to the base section 10.

Resilient locking lances 72 are stamped out of the side walls 60 for securely retaining the terminal 4 within a cavity of an electrical connector housing. Ideally, the housing cavity and box-shaped body section 56 would fit snugly together (at least at certain points) such that relative movement therebetween is minimal to prevent chattering of the terminal 4 within the housing. The spring end contact sections 12, 14 are however free to float within the body section 56, preferably with minimal contact against the body section such that vibrations to the body section 56 are not transmitted to the contact section 14.

A stress-limiting tab 74 is stamped from the base wall 58 of the outer body and is positioned in the spring slot 42 of the inner contact so as to prevent over-compression of the spring section 12 when inserting the male tab between the contacts 50. Without the latter, the spring section 12 may be damaged as the spring force is lower than the frictional force for the purposes of limiting fretting corrosion. During operation, i.e. after the first few cycles of vibration, the stress-limiting tab 74 will eventually be positioned in a substantially central portion of the slot 42 such that movements to the contact section 14 do not cause abutment with the tab 74.

Protective flaps 76 are bent from the side walls 60 over lateral ends of the tab entry end 78 so as to provide a preliminary guide means for a mating male tab and to protect the forward portions 48 of the inner contact.

Advantageously therefore, the terminal described herein is simple to manufacture, in particular for miniature contacts and also is particularly effective in avoiding relative movements of the contact section when mated to a complementary contact for avoiding fretting corrosion therebetween.

I claim:

1. A terminal for mating with a complementary terminal inserted in the longitudinal direction, the terminal comprising an inner contact body having a contact section, a longitudinally resilient spring section, a base section and a conductor connection section, where the spring section and base section are positioned intermediate the contact section and connection section, characterized in that the inner contact body has a U-shape formed by a bottom wall and opposed side walls extending from lateral edges thereof, where the longitudinally resilient spring section comprises, in each side wall, resilient beams separated by spring slots and attached together via bridge portions, the beams and bridge portions comprised in the side walls and resiliently bendable substantially in the planes of the side walls.

2. The terminal of claim 1 characterized in that the resilient beams are bent into further base portions comprised in the bottom wall.

3. The terminal of claim 2 characterized in that a pair of adjacent base portions are attached together via a joining portion comprised in the bottom wall.

4. The terminal of claim 3 characterized in that at least one of the spring slots extends continuously from one side wall across the bottom wall to the other side wall.

5. The terminal of claim 1 characterized in that there are two pairs of spring beams and bridging portions in each side wall.

6. The terminal of any preceding claim characterized in that a box-shaped outer body is positioned over the inner contact body and locked there.

7. The terminal of claim 6 characterized in that the outer body has an inwardly directed projection engageable against the contact section of the inner contact body for limiting longitudinal resilient movement thereof.

8. The terminal of claim 6 characterized in that the outer body has sidewalls substantially parallel and adjacent to the inner contact body side-walls, whereby at a tab receiving end of the outer body, are inwardly bent extensions spanning across a forward section of the inner contact body side walls.

9. The terminal of claim 1 characterized in that the contact section comprises opposed cantilever beam contact arms attached to a forward section of the side walls and extending rearwardly to a free end proximate the spring section.

* * * * *